US008439384B1

(12) United States Patent
Woods

(10) Patent No.: US 8,439,384 B1
(45) Date of Patent: May 14, 2013

(54) SOUND GENERATING DEVICE

(76) Inventor: William M. Woods, Raymond, MN (US)

( * ) Notice: Subject to any disclaimer, the term of this patent is extended or adjusted under 35 U.S.C. 154(b) by 0 days.

(21) Appl. No.: 13/427,896

(22) Filed: Mar. 23, 2012

Related U.S. Application Data

(60) Provisional application No. 61/626,159, filed on Sep. 22, 2011.

(51) Int. Cl.
*A63H 5/00* (2006.01)

(52) U.S. Cl.
USPC ..... 280/288.4; 446/404

(58) Field of Classification Search ..... 280/288.4; 40/587, 590; 403/344; D10/116.1; D12/114; 446/404, 415, 397
See application file for complete search history.

(56) References Cited

U.S. PATENT DOCUMENTS

| | | | | |
|---|---|---|---|---|
| 582,096 | A * | 5/1897 | Rominger | 474/144 |
| 1,362,244 | A * | 12/1920 | Farley | 248/59 |
| 2,557,263 | A | 6/1951 | Davis | |
| 2,624,156 | A | 1/1953 | Meyer, Jr. | |
| 2,633,097 | A * | 3/1953 | Frew | 116/56 |
| 2,667,720 | A * | 2/1954 | Connell, Jr. | 446/404 |
| 2,721,421 | A * | 10/1955 | Steele | 446/404 |
| 2,894,357 | A | 7/1959 | Munro | |
| 3,097,447 | A * | 7/1963 | Peham | 447/404 |
| 3,905,151 | A | 9/1975 | Zweigle | |
| 5,941,483 | A * | 8/1999 | Baginski | 248/68.1 |
| 6,039,338 | A | 3/2000 | Perea et al. | |
| 6,079,673 | A * | 6/2000 | Cox | 248/63 |
| 6,394,875 | B1 | 5/2002 | Smith | |
| 6,536,982 | B2 * | 3/2003 | Gibbons et al. | 403/97 |
| 6,565,107 | B1 | 5/2003 | Hartman | |
| 6,589,097 | B2 | 7/2003 | Smith | |
| 7,003,827 | B2 * | 2/2006 | DeMayo | 5/600 |
| 7,694,988 | B2 | 4/2010 | Sturtevant | |
| 2004/0116045 | A1 * | 6/2004 | Coleman | 446/441 |

* cited by examiner

*Primary Examiner* — Anne Marie M Boehler
(74) *Attorney, Agent, or Firm* — Richard John Bartz

(57) ABSTRACT

A sound generating device for a bicycle has a two-piece clamp secured to the front fork of the bicycle to hold a reed having a base and flexible blade that engages the spokes of the bicycle reed to generate audible sounds. The clamp has first and second flanges that engage opposite sides of the base. A fastener clamps the flanges to the base of the reed and holds the two-piece clamp on the front fork of the bicycle.

15 Claims, 9 Drawing Sheets

SOUND GENERATING DEVICE

CROSS REFERENCE TO RELATED APPLICATION

This application claims the priority of U.S. Patent Application Ser. No. 61/626,159 filed Sep. 22, 2011.

FIELD OF THE INVENTION

The invention is an audible sound generating device used with a rotatable member, such as a wheel, having spokes to produce sounds. The device more specifically pertains to a clicker for attachment to a bicycle for simulating the audible sound of an internal combustion motor.

BACKGROUND OF THE INVENTION

Playing and baseball cards have for many years been attached with clothes pins to bicycle frames to locate the ends of the cards adjacent the spokes of the bicycle wheels whereby when the wheels rotate the cards engage the spokes of the wheel and generate audible flapping sounds. In use, the cards wear away, disintegrate, fall off the bicycle or become bent so as to fail to produce the desired flapping sounds. Various bicycle sound generator devices having flaps extended into bicycle wheels to engage the spokes of the wheels whereby the flaps vibrate to produce audible sounds or clicking noise are disclosed in the prior art. Examples of sound generating devices for bicycles and velocipedes are shown and described in the following U.S. patents.

R. Davis in U.S. Pat. No. 2,557,263 discloses a sounding attachment having a clicker operated by a sprocket wheel to simulate the sound of a motor driven vehicle. The clicker is a resilient spring arm mounted on the frame of a bicycle. The arm includes a base accommodating four bolts that engage plates to retain the arm on the frame adjacent the sprocket wheel.

E. Meyer Jr. in U.S. Pat. No. 2,624,156 illustrates a velocipede equipped with a device mounted on the front fork having a resilient vibrator strip for producing a simulated motor noise. A vibrator strap bent to a U-shape located around the front fork has leaf springs supporting the vibrator strap. A pair of bolts secure leaf springs to vibrator strip. The vibrator strip is a plastic sheet having a resonance that produces sounds.

R. Zweigle in U.S. Pat. No. 3,905,151 discloses a noisemaker connected to the frame of a bicycle having a reed that engages the spokes of a wheel. Fingers partially encircle the frame to hold the reed on the frame. Rubber bands or a cord retain the fingers on the frame. In use, the outer end of the reed contacts a spoke of the wheel which bends the reed and releases it to generate sounds which are amplified by a sounding board.

L. Perea and K. Perea disclose in U.S. Pat. No. 6,029,338 discloses a sound generating device for a spoked wheel having a clamp retained on a strut with a pair of bolts. The clamp has a slot and flanges extended outwardly from the slot. A flap has an anchor bead located in the slot and a flap located between the flanges and extended outwardly from the flanges. The flap is resilient and engageable with the spokes of a wheel to generate audible sounds.

T. Smith in U.S. Pat. No. 6,394,875 discloses a device mounted on a rear frame of a bicycle for making a sound when a flexible member contacts the spokes of a wheel. A horn shaped tube engageable with the flexible member functions to reduce sonic backwash and interference of a sound waves generated by the flexible member.

L. Hartman in U.S. Pat. No. 6,565,107 discloses a device for attachment to a bicycle for simulating the sound of a motor. The device comprises a semi-rigid plastic strap having a straight portion and a circular portion located about the front fork of a bicycle. A bolt retains the strap on the front fork of the bicycle.

T. Sturtevant in U.S. Pat. No. 7,694,988 discloses a bicycle sound generator having a thin plastic member wrapped around the front fork of the bicycle. The member includes an elongated tapered portion having an end that encounters the spokes of the wheel of the bicycle to generate sounds when the wheel rotates. A fastener, such as a cable tie or string, secures the member to the front fork of the bicycle.

SUMMARY OF THE INVENTION

The invention is a device for generating audible sounds with a flexible reed mounted on a support. The support has first and second flanges with aligned first holes and aligned second holes spaced from the first holes. The reed has a base and a blade adapted to engage and disengage a movable member to generate audible sounds. The base has a first hole aligned with the first holes in the flanges and a second hole aligned with the second holes in the first and second flanges. A pin located in the second holes in the first and second flanges extends through the second hole in the base retaining the base between the first and second flanges. A fastener, such as a screw, located in the first holes in the first and second flanges extends through the first hole in the base. The fastener clamps the first and second flanges to opposite sides of the base whereby the fastener and pin prevent movement of the base of the reed relative to the first and second flanges of the support and allow the blade of the reed to vibrate when it engages and disengages from the movable member.

A particular embodiment of the sound generating device is used with a velocipede, such as a bicycle, having a front fork and a wheel mounted on the front fork. The wheel has a plurality of generally radial spokes connecting the hub of the wheel to a circular rim supporting a tire. A clamp has first and second members connected with a pivot member to allow the first and second members to be placed on and engage opposite portions of the front fourth of the velocipede. The first member has a first body and a first flange extended away from the first body. The second member has a second body and a first flange extended away from the second body. The first and second bodies are connected with the pivot member and engage opposite portions of the front fourth of the velocipede. The first and second flanges are located in generally parallel spaced relationship. The first and second flanges have aligned first holes and aligned second holes spaced from the first holes. A reed connected to the clamp is adapted to contact the spokes of the wheel when the wheel is rotated or when the velocipede is moved along a surface, such as a sidewalk or road. The reed has a generally flat base and a blade joined to and extended laterally from the base. The outer end portion of the blade is located in the path of movement of the spokes of the wheel whereby the blade engages and disengages the spokes of the wheel causing the blade to vibrate and generate audible flapping sounds. The base located between the first and second flanges has a first hole aligned with the first holes in the first and second flanges and a second hole aligned with the second holes in the first and second flanges. A pin located with a tight fit in one hole of the second holes in the second flanges and located with a loose fit in the other hole of the second holes in the second flanges and extended through the second hole in the base retains the base between the first and second flanges. The loose fit of the pin in the other hole of the second holes in the second flanges allows the first and second members of the clamp to pivot to an open position to allow the clamp to be placed on and removed from the front fork of the velocipede. A fastener located in the first holes of the first and second flanges and extended through the first hole in the base clamps the first and second body on the front fork of the velocipede and clamps the first and second flanges to opposite sides of the base whereby the fastener and pin prevent movement of the base of the reed relative to the first and second flanges and allow the blade to vibrate to generate audible sounds. The fastener is a screw member having threads that cooperate with threads on one of the flanges to clamp the first and second flanges on the base of the reed.

DESCRIPTION OF THE INVENTION

Figure 1:
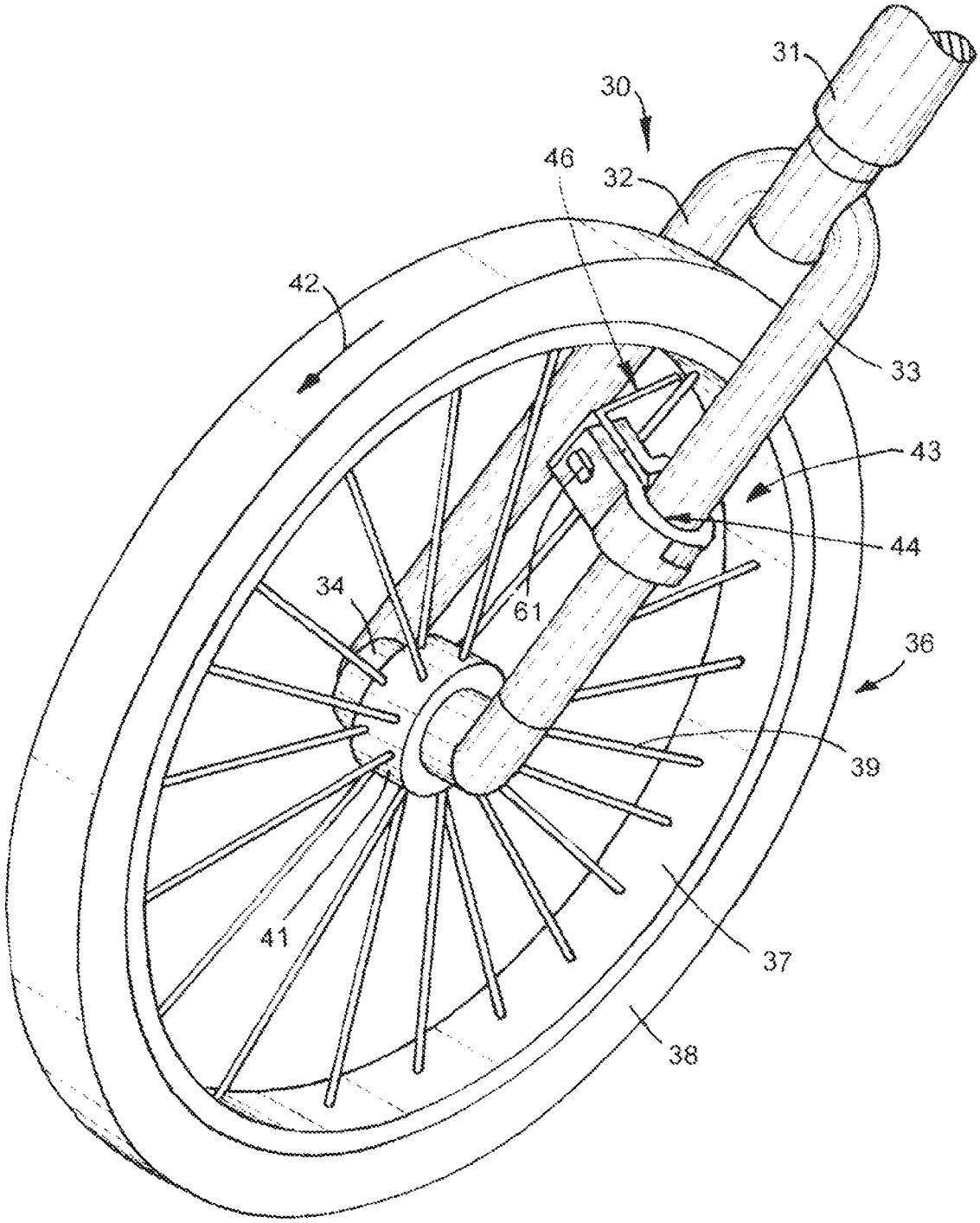
FIG. 1 is a perspective view of a front wheel of a bicycle with a sound generating device attached to the bicycle front fork.

The front of a velocipede 30, shown in FIG. 1, has an upright steering column 31 supporting downwardly extended front fork members 32 and 33. A generally horizontal axle 34 secured to the lower ends of fork members 32 and 33 rotatably supports a front wheel 36. Wheel 36 located between fork members 32 and 33 has a cylindrical rim 37 and a pneumatic tire 38 mounted on rim 37. A plurality of radial wire spokes 39 connects rim 37 to a hub 41. Bearings (not shown) rotatably mount hub 41 on axle 34. Wheel 36 rotates in a counterclockwise direction, shown by arrow 42, when velocipede 30 is moved in a forward direction. Velocipede 30 is a conventional bicycle, tricycle, draisine, wheelchair or a vehicle with one or more spoked wheels.

A sound generating device 43 mounted on fork member 33 with a clamp 44 has a flexible reed 46 that is sequentially engaged with spokes 39 of wheel 36 to produce audible sounds that simulates the sounds of noise of an internal combustion engine of a motorcycle, automobiles or a motor boat. Sound generating device 43 can be attached to other parts of the velocipede frame including but not limited to the rear wheel supports and fender holding members. The audible sounds are relatively low-pitched popping or flapping noise rather than rattle sounds obtained when a playing card or stick is contacted by the moving spokes of the wheel. Sound generating device 43 can be used with moving machines having separated members engageable by reed 46 to generate audible sounds.

Figure 2:
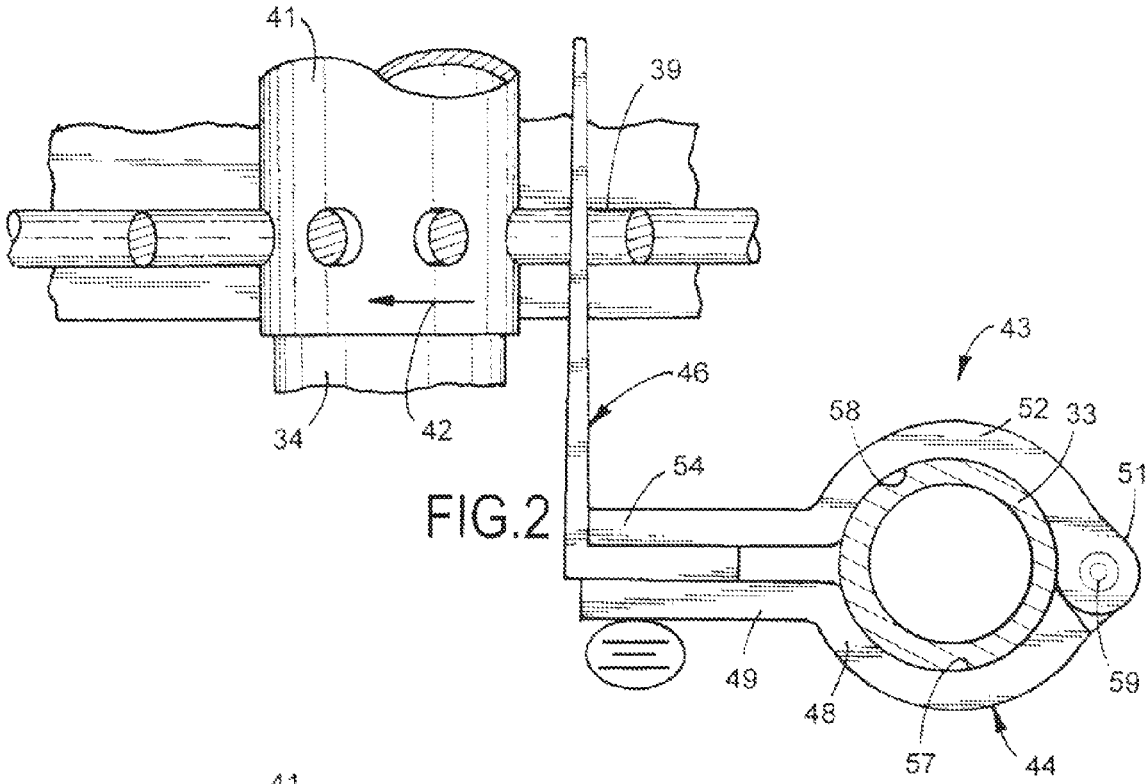
FIG. 2 is a cross sectional view of the sound generating device of FIG. 1 illustrating the reed of the sound generating device extended between adjacent spokes of the front wheel of the bicycle.
Figure 3:
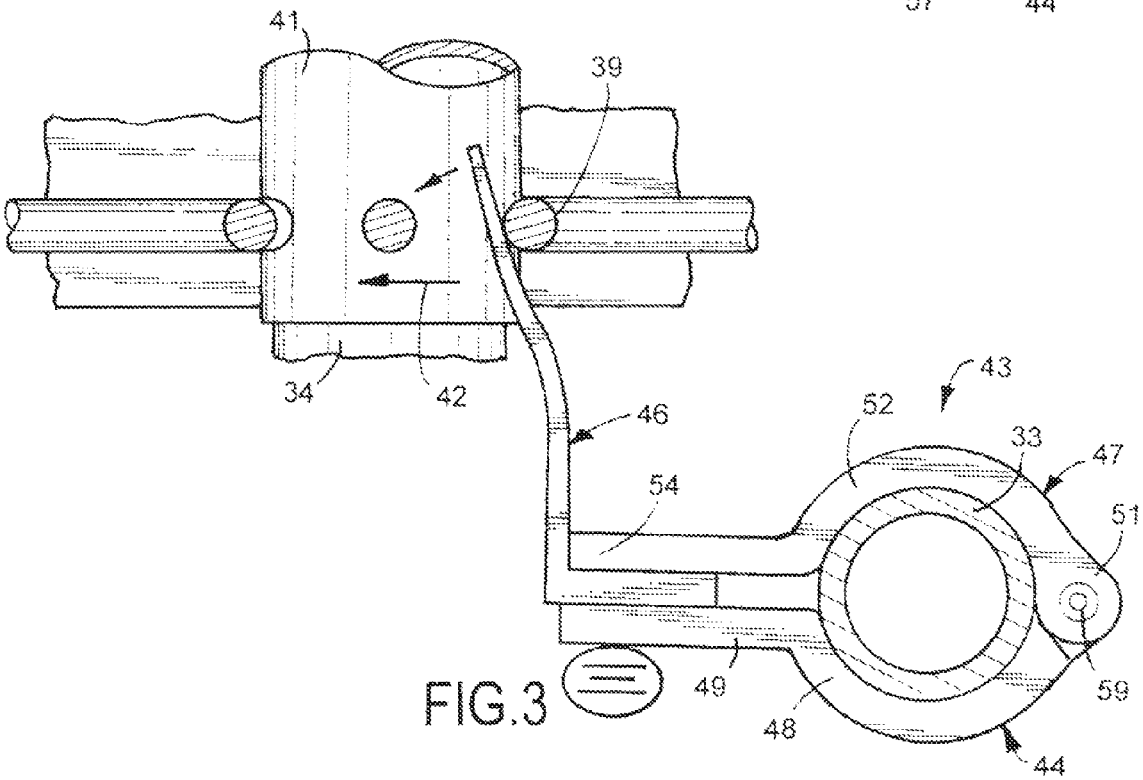
FIG. 3 is a cross sectional view identical to FIG. 2 illustrating the reed of the sound generating device engageable with a spoke of the front wheel of the bicycle.
Figure 4:
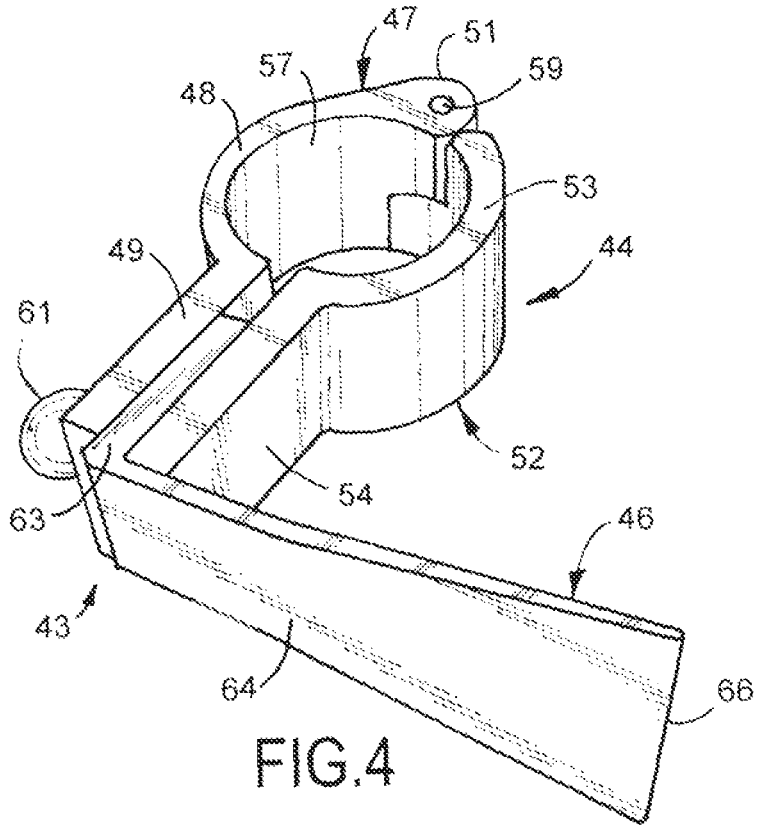
FIG. 4 is a perspective view of the sound generating device of FIG. 1.
Figure 6:
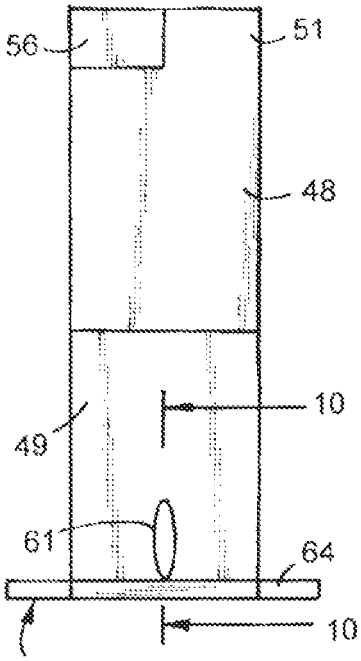
FIG. 6 is a side elevational view of the left side of the sound generating device of FIG. 4.
Figure 7:
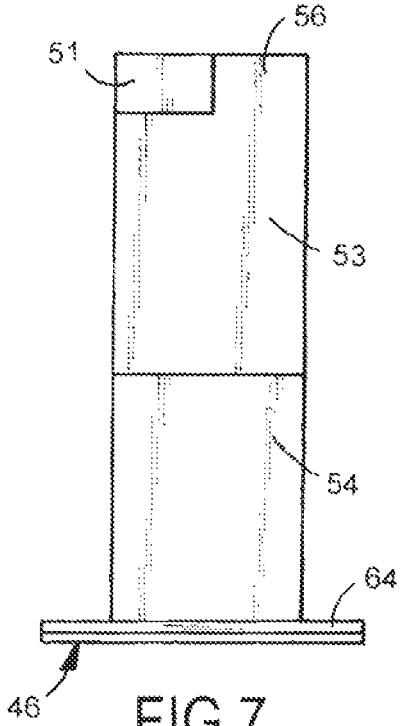
FIG. 7 is a side elevational view of the right side of the sound generating device of FIG. 4.
Figure 8:
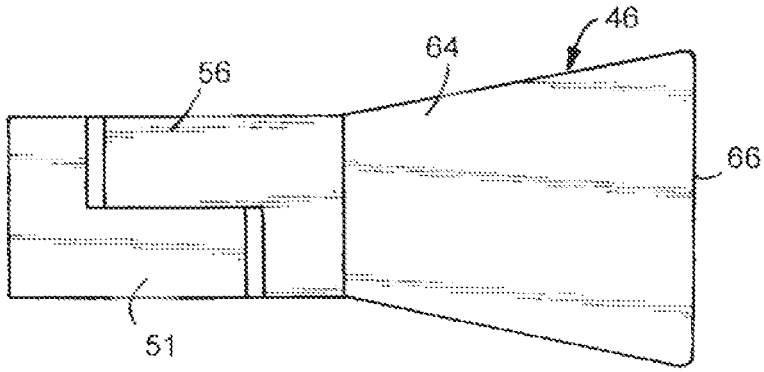
FIG. 8 is a rear elevational view of the sound generating device of FIG. 4.
Figure 9:
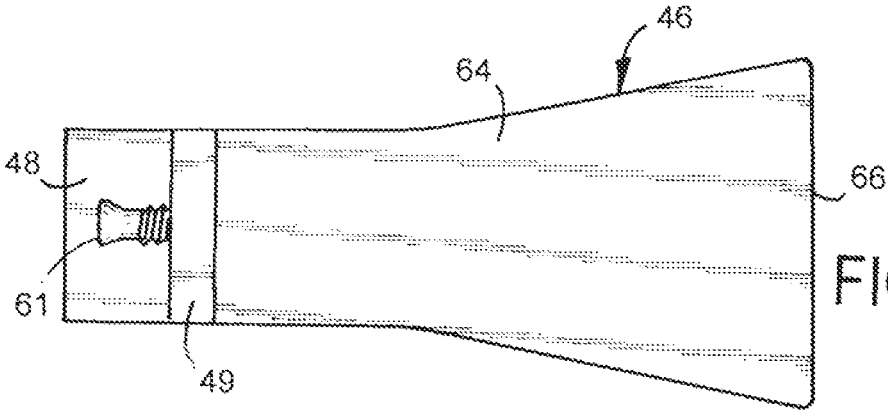
FIG. 9 is a front elevational view of the sound generating device of FIG. 4.

Clamp 44 has first and second members 47 and 52 located on fork member 33 to retain clamp 44 on fork member 33. First member 47 has a semi-cylindrical body 48 joined to a flat flange or ear 49 and a hinge portion or boss 51. Second member 52 has a semi-cylindrical body 53 joined to a flat flange or ear 54 and a hinge portion or boss 56. Bodies 48 and 53 have inside semi-cylindrical surfaces 57 and 58. As shown in FIGS. 2 and 3, cylindrical surfaces 57 and 58 are located in firm surface engagement with opposite cylindrical sections of fork member 33. The bodies 48 and 52 can have different sizes and shapes to accommodate different sizes and shapes of fork members and other parts of velocipede 30. The bosses 51 and 56, as shown in FIGS. 6, 7 and 8, overlap and laterally contact each other. A transverse pivot pin 59 extended through bosses 51 and 56 pivotally connects bosses 51 and 56 whereby first and second members 49 and 52 are movably between open and closed positions. A fastener 61, shown as a thumb screw 62 in FIG. 10, threaded into holes 67 and 69 in flanges 49 and 54 forces bodies 48 and 53 into firm engagement with fork member 33.

As shown in FIGS. 12 to 18, reed 46 is a one-piece member having a generally square flat base 63 and a flat tapered blade or finger 64 with a straight transverse end 66. Reed 46 is a one-piece flexible plastic, such as polyethylene or nylon. Other plastics and materials, such as metal, a composite material and wood, can be used for reed 46. The plastic of reed 46 has memory properties that allow the reed to vibrate when flexed, bent or moved from its natural at rest shape. The vibrating reed 46 along with contact with the spokes of the rotating wheel generate audible sounds. Reed 46 has outwardly tapered sides with end 66 larger than the width of base 63. For example, blade 64 has a length of three inches with the base a one-inch square. The outer end 66 has a width of two inches. The thickness of blade 64 tapers from ⅛ inch to 1/16 of an inch. The angle between base 63 and blade 64 is 85 to 88 degrees or slightly less than 90 degrees. The reed 46 can have other angles, including 90 degrees, between base 63 and blade 64. The color of the plastic of reed 46 can be solid, striped or spotted. The flat surfaces of reed 46 can accommodate designs, logos, names, numbers and advertising.

Figure 5:
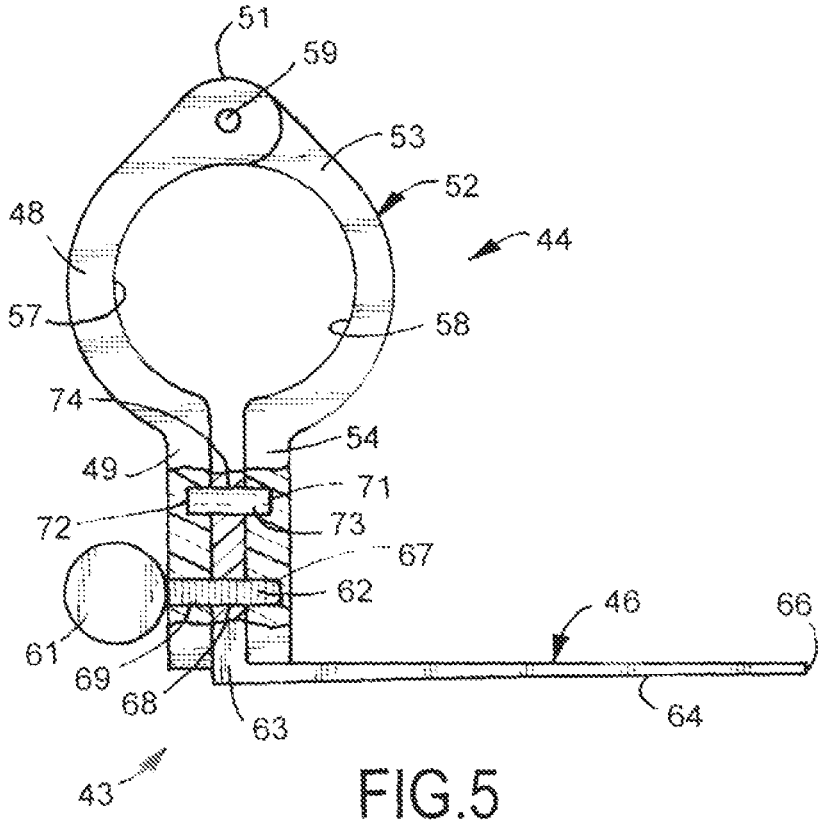
FIG. 5 is a top plan view, partly sectioned, of the sound generating device of FIG. 4.
Figure 10:
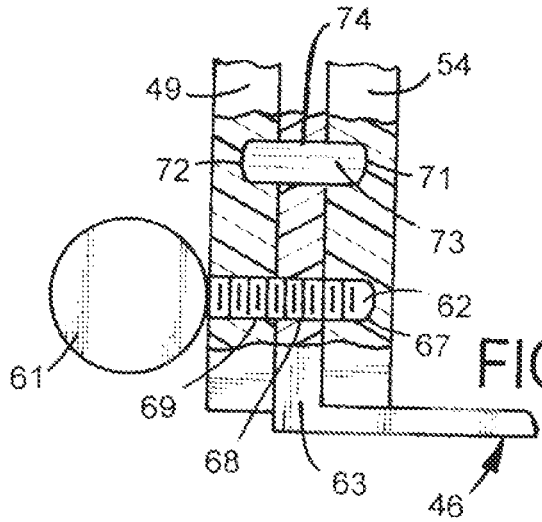
FIG. 10 is an enlarged sectional view taken along the line 10-10 of FIG. 6.
Figure 11:
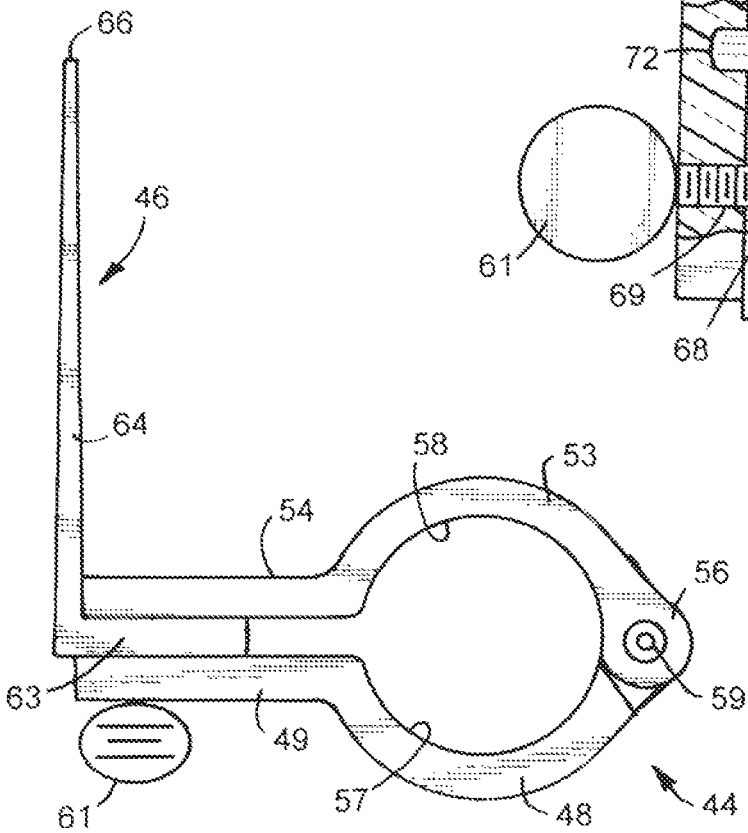
FIG. 11 is a side elevational view of the left side of the sound generating device of FIG. 4.
Figure 12:
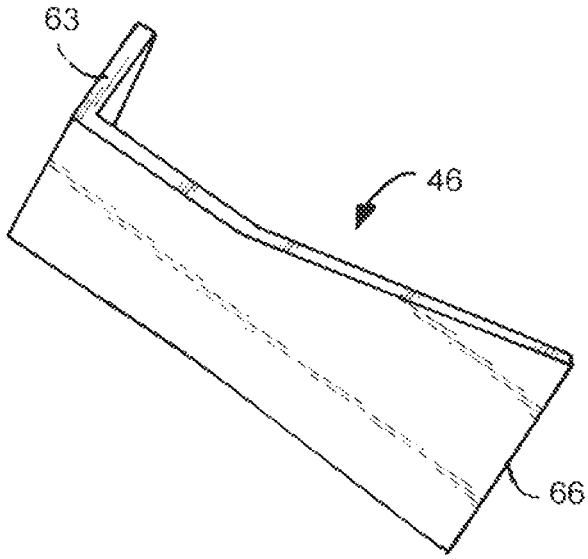
FIG. 12 is a perspective view of the reed of the sound generating device of FIG. 4.
Figure 13:
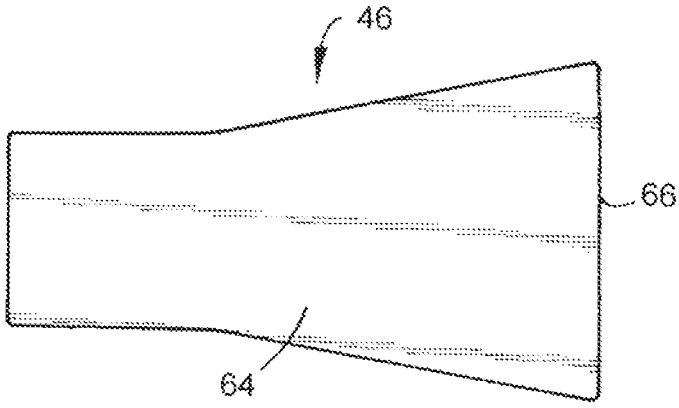
FIG. 13 is a front elevational view of FIG. 12.
Figure 14:
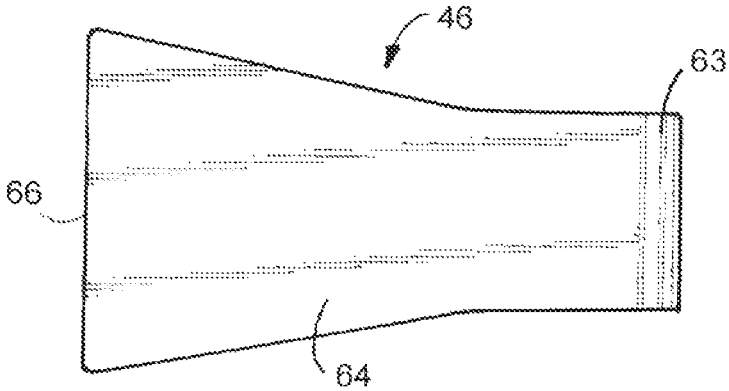
FIG. 14 is a rear elevational view of FIG. 12.
Figure 15:
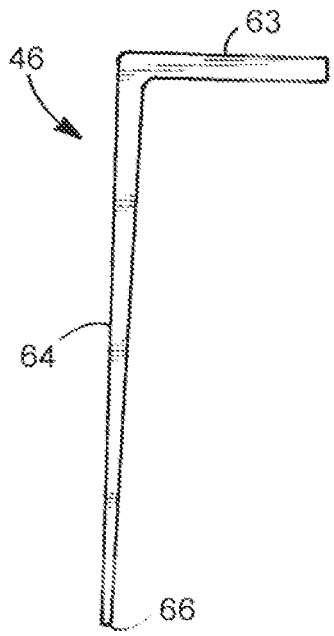
FIG. 15 is a top plan view of FIG. 12.
Figure 16:
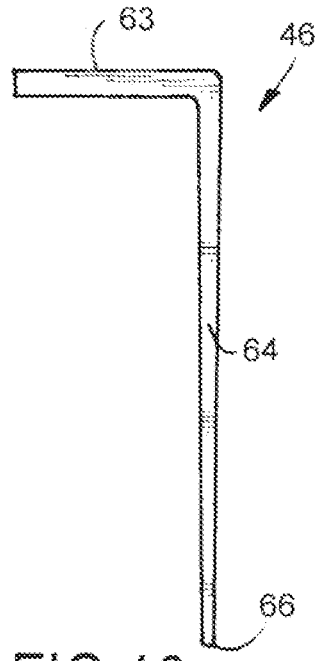
FIG. 16 is a bottom plan view of FIG. 12.
Figure 17:
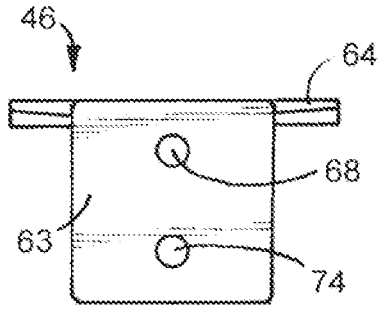
FIG. 17 is an end elevational view of the left end of FIG. 12.
Figure 18:
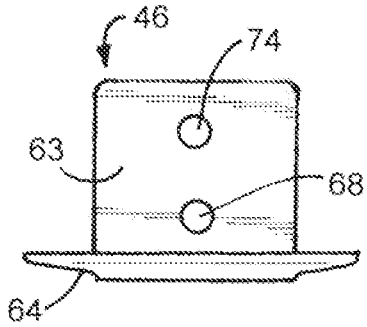
FIG. 18 is an end elevational view of the right end of FIG. 12.
Figure 19:
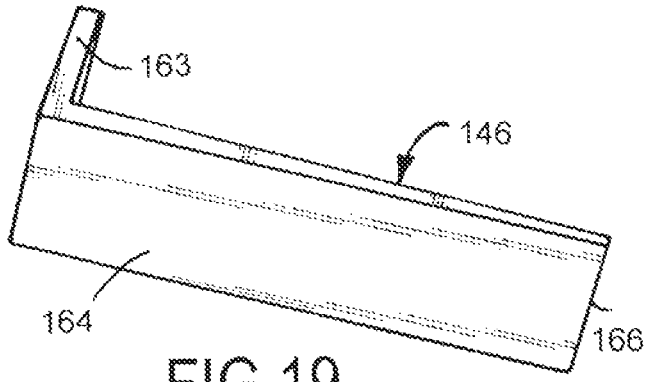
FIG. 19 is a perspective view of a modification of the reed of FIG. 12.
Figure 20:
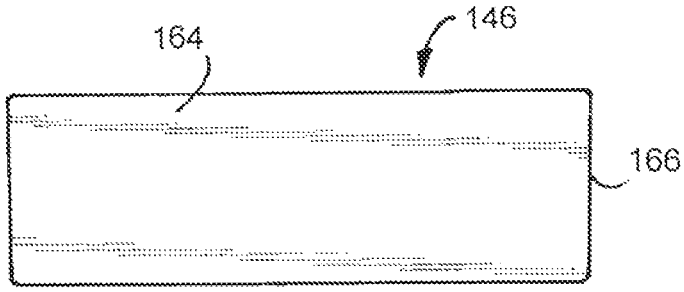
FIG. 20 is a front elevational view of FIG. 19.
Figure 21:
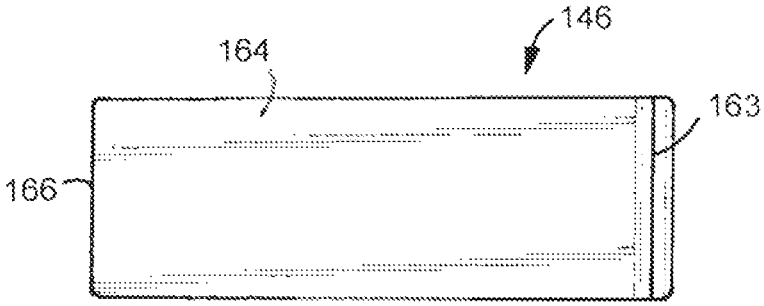
FIG. 21 is a rear elevational view of FIG. 19.
Figure 22:
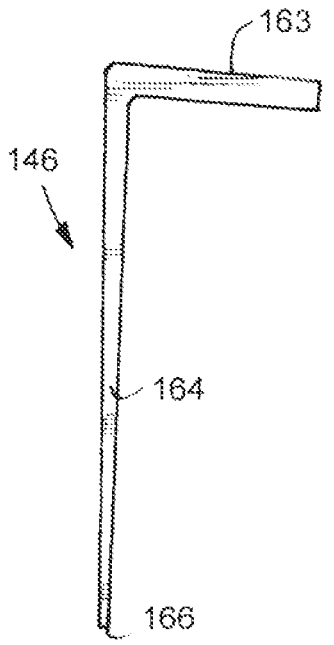
FIG. 22 is a top plan view of FIG. 19.
Figure 23:
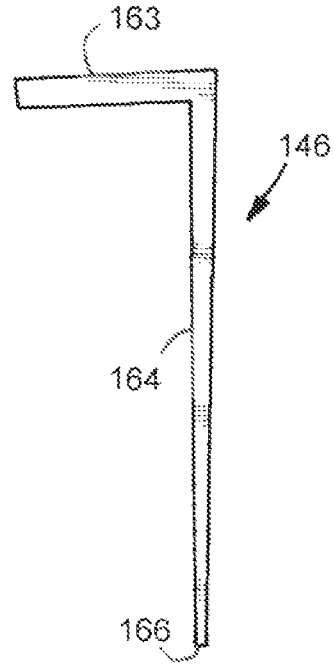
FIG. 23 is a bottom plan view of FIG. 19.

Base 63 has two holes 68 and 74 located in the middle section of the base. As shown in FIGS. 5 and 10, hole 68 is aligned with holes 67 and 69 in flanges 49 and 54 to accommodate a fastener 61 shown as a thumb screw 62, whereby thumb screw 62 clamps base 63 between flanges 49 and 54. Flange 49 and 54 are retained in surface contact with opposite sides of base 63. Hole 74 is aligned with blind holes 71 and 72 in flanges 49 and 54. A split pin 73 located in blind holes 71 and 72 extends through hole 74 in base 63. Pin 73 has a tight or force fit in hole 71 to fix pin 73 to flange 54 whereby pin 73 does not fall out of hole 71 when clamp 44 is moved between open and closed positions. The opposite end of pin 73 has a loose fit in hole 72 in flange 49 so as to allow clamp 44 to be moved between open and closed positions. The pin can be a projection joined to flange 54 and extended into blind hole 72 in flange 49. The fastener 61 and pin 73 prevents blade 64 from twisting and turning on flanges 49 and 54. Reed 46 can be removed from clamp 44. The clamping function of fastener 61 also retains split pin 73 in engagement with base 63.

Figure 24:
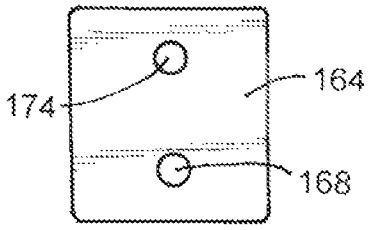
FIG. 24 is an end elevational view of the left end of FIG. 19.
Figure 25:
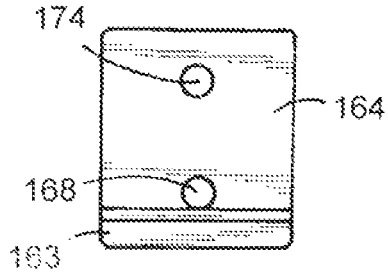
FIG. 25 is an end elevational view of the right end of FIG. 19.

A modification of the reed 146 shown in FIGS. 19 to 25, is a one-piece flexible plastic member having a base 163 joined to a flat tapered blade 164. The outer end 166 of blade 164 has the same width as base 163. As shown in FIGS. 24 and 25, base 164 has two holes 168 and 174 to accommodate a pin and fastener as shown in FIG. 10 as pin 73 and fastener 61. An example reed 146 has a rectangular plastic blade 164 having a length of 3 inches and a width of 1 inch. The thickness of blade 164 tapers from ⅛ inch to 1/16th inch. The base 163 is a one-inch square plastic joined to an end of blade 164. Base 163 has uniform thickness of 3/16th inch. Reed 146 can have other shapes and sizes. Reed 146 is a one-piece flexible plastic, such as polyethylene or nylon. Other plastics and materials, such as metal, composite material and wood, can be used for reed 146. The material of reed 146 has memory properties that allow the reed to vibrate when flexed, bent or moved from its natural at rest shape to produce audible sounds.

The sound generating device has been shown and described in relation to a preferred embodiment and two styles of flexible reeds. Changes in the structures, arrangement of structures and materials of the sound generating device may be made by persons skilled in the art without departing from the invention.

The invention claimed is:

1. A velocipede sound generating device for a velocipede having a front fork and wheel with a plurality of spokes rotatably mounted on the front fork comprising:

a clamp adapted to be mounted on the front fork of the velocipede, a reed connected to the clamp engageable with the spokes of the wheel whereby when the wheel rotates the reed sequentially engages and disengages the spokes of the wheel thereby generating audible sounds, said clamp having a first member and a second member adapted to engage opposite portions of the front fork to retain clamp on the front fork, said first member having a semi-cylindrical first body and a first flange extended away from the first body, said second member having a semi-cylindrical second body and a second flange extended away from the second body, said second flange being laterally spaced from the first flange, said reed having a base and a flexible blade joined to and extended laterally from the base adapted to be engaged by the spokes of the wheel, said base being positioned between the first and second flanges, said first and second flanges having aligned first holes and aligned second holes spaced from the first holes, said base having a first hole aligned with the first holes in the first and second flanges and a second hole aligned with the second holes in the first and second flanges, a pin located with a tight fit in one hole of the second holes in the second flanges and located with a loose fit in the other hole of the second holes in the second flanges and extended through the second hole in the base, and a fastener located in the first holes in the first and second flanges and extended through the first hole in the base, said fastener and at least one of the flanges having cooperating members operable to clamp the first and second flanges to opposite sides of the base whereby the fastener and pin prevent movement of the base of the reed relative to the first and second flanges of the clamp and allow the flexible blade to vibrate to generate audible sounds.

2. The device of claim 1 wherein:

the blade is a flat member having an end remote from the base, said flat member having a thickness that tapers from the base to said end.

3. The device of claim 1 wherein:

the blade has a first end and a second end remote from the first end, the base extends laterally away from the first end of the blade.

4. The device of claim 1 wherein:

the second holes in the first and second flanges are blind holes.

5. The device of claim 1 wherein:

the fastener is a threaded member threaded into at least one of the first holes in the first and second flanges.

6. A velocipede sound generating device for a velocipede having a frame and a rotatable wheel with a plurality of spokes located adjacent the frame comprising:

a clamp mountable on the frame of the velocipede, a reed connected to the clamp engageable with the spokes of the wheel whereby when the wheel rotates the reed sequentially engages and disengages the spokes of the wheel thereby generating audible sounds, said clamp having a first member and a second member adapted to be located on the frame of the velocipede, said first member including a first flange, said second member including a second flange laterally spaced from the first flange, said reed having a base located between the first and second flanges, and a flexible blade joined to the base adapted to be engaged by the spokes of the wheel, said first and second flanges having aligned first holes and aligned second holes, said second holes comprising a first blind hole in the first flange and a second blind hole in the second flange, said base having a first hole aligned with the first holes in the first and second flanges, and a second hole aligned with the second holes in the first and second flanges, a pin located in the second holes in the first and second flanges and extended through the second hole in the base, said pin having one end located in a tight fit in the first blind hole and the other end located in a loose fit in the second blind hole thereby allowing the first and second flanges to be moved away from each other whereby the base of the reed can be located between first and second flanges and removed from the first and second flanges, and a fastener located in the first holes in the first and second flanges and extended through the first hole in the base, said fastener cooperating with the first and second flanges to clamp the first and second flanges to the base whereby the fastener and pin prevent movement of the base of the reed relative to the clamps and allow the flexible blade to vibrate to generate audible sounds.

7. The device of claim 6 wherein:

said first member including an arcuate first body having an inside surface adapted to engage the frame of the velocipede, said first flange being joined to the first body, said second member including an arcuate second body having an inside surface adapted to engage the frame of the velocipede whereby the first and second bodies mount the clamp on the frame of the velocipede, and said second flange being joined to the second body.

8. The device of claim 6 wherein:

the blade is a flat flexible member having an end remote from the base, said flat member having a thickness that tapers from the base to said end.

9. The device of claim 6 wherein:

the base extends laterally away from the blade.

10. The device of claim 6 wherein:

the angle between the base and blade is less than 90 degrees.

11. The device of claim 6 wherein:

the fastener is a threaded member threaded into at least one of the first holes in the first and second flanges.

12. A sound generating device comprising:

a support, a reed connected to the support adapted to generate an audible sound when the reed vibrates, said support having first and second flanges, said first and second flanges having aligned first holes and aligned second holes spaced from the first holes, said second holes having one blind hole in the first flange and another blind hole in the second flange, said reed having a base and a blade, said base having a first hole aligned with the first holes in the first and second flanges and a second hole aligned with the second holes in the first and second flanges, a pin having a first end located in tight fit in the one blind hole in the first flange and a second end located in a loose fit in the another blind hole in the second flange thereby allowing the first and second flanges to be moved away from each other whereby the base of the reed can be located between the first and second flanges and removed from between the first and second flanges, said pin extended through the second hole in the base, and a fastener located in the first holes in the first and second flanges and extended through the first hole in the base, said fastener being operable to clamp the first and second flanges to opposite sides of the base whereby the fastener and pin prevent movement of the base of the reed relative to the first and second flanges of the support and allow the blade to vibrate to generate audible sounds.

13. The device of claim 12 wherein:

the blade is a flat member having an end remote from the base, said flat member having a thickness that tapers from the base to said end.

14. The device of claim 13 wherein:

the blade has a first end and a second end remote from the first end, the base extends laterally away from the first end of the blade.

15. The device of claim 13 wherein:

the fastener is a threaded member threaded into at least one of the first holes in the first and second flanges.

* * * * *